United States Patent [19]

Bonnell

[11] Patent Number: 4,792,088

[45] Date of Patent: Dec. 20, 1988

[54] INDESTRUCTIBLE MAILBOX

[76] Inventor: Raymond Bonnell, Rte. 1, Box 240B, Bunker Hill, Ill. 62014

[21] Appl. No.: 156,004

[22] Filed: Feb. 18, 1988

[51] Int. Cl.[4] ..... B65D 91/00

[52] U.S. Cl. ..... 232/17; 232/39; 248/156; 248/160

[58] Field of Search ..... 232/17, 39; 248/156, 248/160

[56] References Cited

U.S. PATENT DOCUMENTS

| | | | |
|---|---|---|---|
| 2,082,272 | 6/1937 | Zinnow | 248/160 X |
| 2,911,174 | 11/1959 | Goss | 248/160 |
| 4,367,844 | 1/1983 | Drummond | 232/39 X |

*Primary Examiner*—Robert W. Gibson, Jr.
*Attorney, Agent, or Firm*—Don W. Weber

[57] ABSTRACT

A sturdy, virtually indestructible mailbox is presented comprising a thick-gauged cylindrical mailbox shell, a top pipe stem, a middle resilient spring stem and a bottom anchor post pipe stem having a circular driving auger. The shell and stems are connected by means of horizontal holes in the pieces through which are inserted first, second and third attaching bolts.

The inside of the mailbox shell includes a perforated horizontal letter tray and a spring-ball latch mechanism that contacts an inner horizontal door flange for latching the door of the mailbox.

6 Claims, 2 Drawing Sheets

INDESTRUCTIBLE MAILBOX

BACKGROUND OF THE INVENTION

This invention relates to the fold of mailboxes and mailbox supports. It particularly involves a sturdy, normally indestructible mailbox and support which has the unique feature of being able to withstand shear stress or shock due to objects, e.g. automobiles.

Other inventors have addressed the problem of creating sturdy mailboxes that would not be totally destroyed by everyday wear and tear. Hall (U.S. Pat. No. 4,213,560) addressed the problem of a mailbox support adjustable as to height. Diamond (U.S. Pat. No. 4,498,621) devised a mailbox and support than is in sections, and Delke (U.S. Pat. No. 4,286,747) tackled the problem of automobile collision and other shock as applied to mailbox supports. Delke's support is designed to break when shocked by a sudden force, as an automobile bumper. Delke recognized the problem of dealing with mechanical shock to the mailbox, but resolved it in a different manner.

The present invention solves the problem approached by Delke by providing a resilient spring section of the support. The spring section yields to the mechanical shock, but, unlike Delke, it rebounds to its original erect position once the lateral force is removed. The thickness of the pipe used and the vertical spring portion make the mailbox and support indestructible under normal condition. Even the shock of running into the mailbox with an automobile will not permanently damage this device.

Further, vandals or other destructive forces, such as high winds, will not be able to damage the mailbox because of its sturdy construction.

An object of this invention is to provide a sturdy mailbox and support which provides a resilient element in the support able to rebound from lateral shock.

Another object of this invention is to provide a sturdy mailbox that is vandal and element resistant to a high degree.

Yet another object of the invention is to provide a mailbox and support that is strong enough to withstand exceptional wear and tear yet flexible enough to yield to vehicles so as not to damage the auto or other vehicle with which it comes in contact.

BRIEF SUMMARY OF THE INVENTION

A sturdy mailbox and support are presented which include a resilient spring pipe stem for absorbing mechanical shock. The mailbox shell consists of a round cylinder having one end closed. At the other end of the cylinder is a hinged door which is closed by a spring-loaded latch means. To protect the mail inserted into the mailbox, from rain or other damage a horizontal mail tray made of wire mesh or other perforated material is fixed in the bottom of the mailbox shell. Drain holes are drill into the bottom of the shell. A signal flag is hingedly attached to the outside of the mailbox.

The bottom of the mailbox has an annular flange. Connected to the annular flange is a top pipe which in turn is connected to a spring stem. The spring stem is above the bottom pipe stem. All three stems are connected by means of horizontal attaching bolts. The bottom pipe stem has a circular auger attached thereto to facilitate driving the support into the ground.

DETAILED DESCRIPTION OF THE PREFERRED EMBODIMENT

Figure 4:
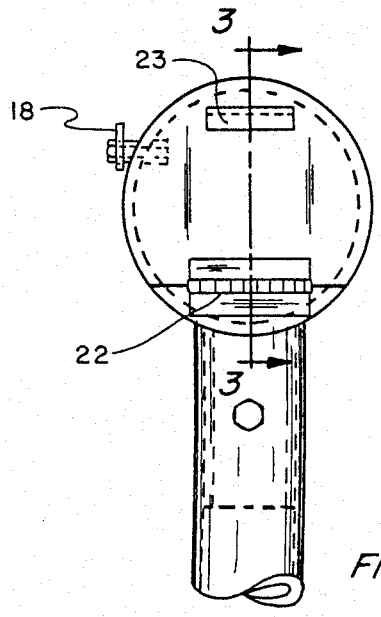
FIG. 4 is a front end view of the upper portion of the mailbox.

The main shell of the mailbox (1) is comprised of heavy guage cylindrical pipe. In practice, the shell has an 8 inch diameter with approximately a $\frac{1}{8}$ inch wall thickness. The pipe is preferably made of steel or cast iron so as to be vandal-proof and virtually indestructible. The back end of the shell has attached thereto, by welding or otherwise, a $\frac{1}{8}$ inch thick circular end plate (21). On the opposite end of the shell a circular door is hingedly attached as shown in FIG. 4. The hinges are in the lower portion of the end-section of the front of the mailbox as shown. An outer door handle (23) is attached to the outside of the door to facilitate opening and closing. On the bottom of the shell is an annular base flange (3) which has a longitudinal hole drilled therein to accomodate a first attaching bolt (5). The annular flange has an approximate outside diameter of $2\frac{1}{2}$ inches, and could be a portion of Schedule 40 pipe.

The stem comprises three main parts: a top pipe stem (4); a middle spring stem (8) and a bottom pipe stem (12). The upper end of the top pipe stem (6) fits over the annular base flange (3). The upper end has a hole drilled through it to accomodate the first attaching bolt (5) which secures the mailbox shell to the top pip stem. The top pipe stem is Pipe Schedule 40 pipe approximately 3" outside diameter pipe. The lower end (7) of the top pipe stem has a second hole drilled therethrough to accomodate a second attaching bolt (11).

The middle of the mailbox support comprises a resilient spring stem (8) having an upper (9) and lower (10) annular spring flanges. The spring itself (8) has a 2" to 8" diameter with a wire size of $\frac{1}{2}$ inch. These spring sizes vary according to the size and weight of the material used for the mailbox shell. The purpose of the spring is to provide safety and resilience in case of mechanical shock to the device by a vehicle or other abnormal circumstance. The resilient spring allows the device to be forced to a horizontal position on impact while springing to the vertical once the force is removed. The upper and lower spring flanges consist of flat circular metal plates (25) having annular pipe-like flanges welded thereto so that the longitudinal axis of the flange is perpendicular to the surface of the plate. Each annular spring flange has a hole drilled therethrough to accomodate a second attaching bolt (11) for the upper spring flange and a third attaching bolt (24) for the lower spring flange (10). The circular metal plates (25) are made of $\frac{1}{4}$ inch to $\frac{1}{2}$ inch plate.

Figure 2:
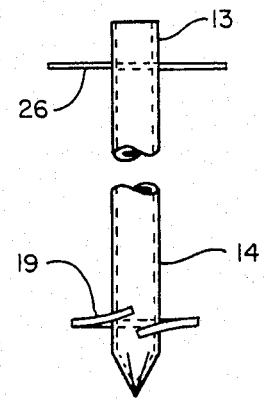
FIG. 2 is a side view of the bottom pipe stem showing the circular auger piece attached.

The bottom anchor post pipe stem (12) is the portion of the device that is first driven or turned into the ground. This anchor post pipe stem is normally $2\frac{1}{2}$ inch diameter Schedule 40 pipe. The upper end (13) of the bottom anchor post pipe stem has a hole drilled therethrough to accomodate the third attaching bolt (24). The lower end of the bottom anchor post is made so that it has a point to facilitate setting the post in the ground by driving or turning. The preferred embodiment of this final bottom pipe stem includes an auger-type disc, as shown in FIG. 2. This auger disc (19) is welded to the post and is designed to pull he bottom anchor post pipe stem (12) into the ground when the pipe is turned. To impart rotational force to the auger and bottom post one simply inserts a strong metal rod (26) through the third attaching bolt hole and turning the rod. n alternate method of driving and setting the bottom pipe stem is to simply drive it with a sledge hammer or other device. Driving the post, of course, only is used when there is no auger plate attached to the bottom pipe stem.

Figure 1:
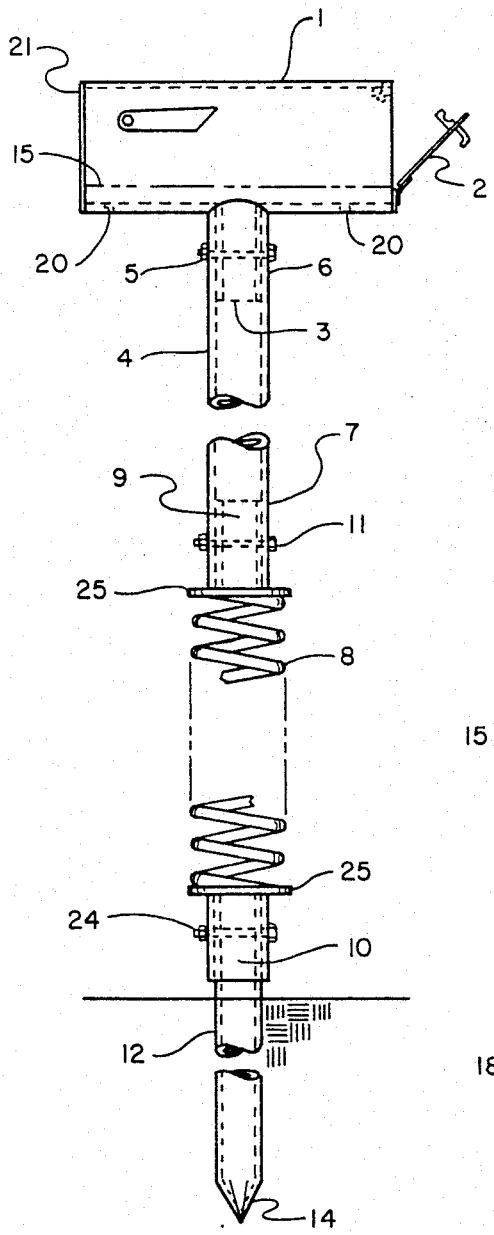
FIG. 1 is a side exploded view of the invention.

The preferred embodiment of the device also includes a flat, horizontal, perforated letter try (15) located inside the shell at about the same level as the door hinge, as shown on FIG. 1. This tray is made preferably of wire mesh or other perforated metal. It is welded to the inside of the shell. Its purpose is to protect against dampness which accumulates in the mailbox. The tray keeps the mail off any accumulated water, ice or other elements. In order to avoid an undue accumulation of water, a plurality of drain holes (20) are drilled in the underside of the shell.

Figure 3:
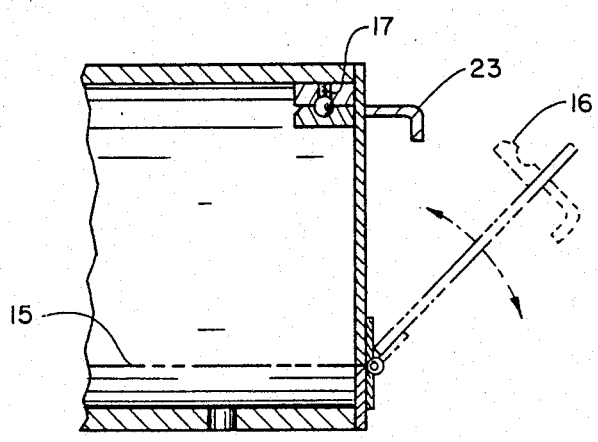
FIG. 3 is a side view of the front end of the mailbox showing the latching mechanism, taken along the line 3—3 in FIG. 4.

A latch-means is also provided to facilitate closure of the door. To the inside of the door (2) is attached an inner horizontal door flange (16). This inner door flange is perpendicular to the plane of the door and has asmall semicircular dimple in it. When the door is closed, this dimple contacts a spring-loaded ball latch (17), best shown on FIG. 3. The spring depresses the ball into the dimple and keeps the door closed.

A signal flag (18) is also hingedly positioned on the outside of the shell by any familiar means known in the art.

The indestructible mailbox is erected by first setting the bottom anchor post pipe stem (12) in the ground by driving or turning. The resilient spring stem (8) is then attached by using an attaching nut and bolt. Above the spring stem, the top pipe stem is then attached using an attaching nut and bolt. The mailbox shell is then attached at the annular base flange (3) by t e first nut and attaching bolt.

This mailbox, because of its heavy metal construction and unique resilient spring stem will be able to withstand the ordinary bumps from vehicles and other mechanical shocks. The device ma bend, bu will always return to its normal vertical position. Because the mailbox and support are easily detachable into component parts, an owner may take the device with him when he moves. The mailbox and support, when properly painted, will last many years without deterioration.

The description provided herein is meant by way of illustration only and not of limitation. Obvious variations of size, weight, thickness and attaching means are encompassed within the spirit of this invention.

Having thus fully described my invention, I claim:

1. A sturdy mailbox and support, comprising:
(1) a cylindrical mailbox shell closed at one end having a hingedly attached door at the other end, also having a cyclindrical annular base flange located on the bottom thereof;
(2) a top pipe stem having an upper end attached to the shell annular base flange by a first attaching bolt and a lower end;
(3) a spring stem having an upper end attached to the lower end of the top pipe stem by a second attaching bolt and a lower end;
(4) a bottom anchor post pipe stem having an upper end attached to the lower end of the spring stem and a lower, pointed end for driving into the ground.

2. A sturdy mailbox and support as in claim 1, further comprising a perforated, horizontal letter tray fixedly attached to the inside lower portion of the mailbox shell.

3. A sturdy mailbox and support as in claim 1, wherein said mailbox door has an inner horizontal door flange, further comprising a spring-loaded latch which engages the inner door flange and latches the door.

4. A sturdy mailbox and support as in claim 1, further comprising a signal flag hingedly attached to the outside of the mailbox shell.

5. A sturdy mailbox and support as in claim 1, further comprising a circular auger fixedly attached to the lower end of the bottom pipe stem.

6. A sturdy mailbox and support as in claim 1, further comprising a plurality of drain holes in the bottom of said mailbox shell.

* * * * *